US011028986B2

(12) United States Patent
Wang et al.

(10) Patent No.: US 11,028,986 B2
(45) Date of Patent: Jun. 8, 2021

(54) SELF-POWER-GENERATING WATER OUTFLOW DEVICE WITH A LIGHT

(71) Applicant: Xiamen Lota International Co., Ltd., Fujian (CN)

(72) Inventors: Xuedong Wang, Fujian (CN); Zhiyong Li, Fujian (CN); Chuanbao Zhu, Fujian (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 16/993,600

(22) Filed: Aug. 14, 2020

(65) Prior Publication Data

US 2021/0048160 A1 Feb. 18, 2021

(30) Foreign Application Priority Data

Aug. 16, 2019 (CN) ..... 201921332006.3

(51) Int. Cl.

| | |
|---|---|
| ***F21S 9/04*** | (2006.01) |
| ***F21V 33/00*** | (2006.01) |
| ***B05B 1/18*** | (2006.01) |
| ***F21Y 115/10*** | (2016.01) |

(52) U.S. Cl.

CPC ..... *F21S 9/046* (2013.01); *F21V 33/004* (2013.01); *B05B 1/18* (2013.01); *F21Y 2115/10* (2016.08)

(58) Field of Classification Search

CPC ..... B05B 1/18–1/185; F21S 9/046; F21V 33/004

See application file for complete search history.

(56) References Cited

U.S. PATENT DOCUMENTS 4,616,298 A * 10/1986 Bolson ..... A62C 37/08 290/54
2007/0126237 A1* 6/2007 Liao ..... F03B 13/00 290/43
2015/0211728 A1 7/2015 Zhadanov et al.

(Continued)

FOREIGN PATENT DOCUMENTS

CN 201260997 Y 6/2009
CN 201815400 U * 5/2011 ..... B05B 1/18
CN 202129159 U * 2/2012

(Continued)

*Primary Examiner* — Mariceli Santiago

(74) *Attorney, Agent, or Firm* — Cooper Legal Group, LLC

(57) ABSTRACT

Disclosed is a self-power-generating water outflow device with a light. An LED light source and a driving circuit for driving the LED light source are disposed in a water outflow terminal, and a first positive electrode and a first negative electrode are electrically connected to the driving circuit. A connector is detachably connected to the water outflow terminal. The connector comprises a connection housing and a self-power-generating component. The self-power-generating component is disposed in the connection housing, and the connection housing comprises one or more second positive electrodes and one or more second negative electrodes electrically connected to the self-power-generating component. When the connector is connected to the water outflow terminal, the first positive electrode is in contact with the one or more second positive electrodes and the first negative electrode is in contact with the one or more second negative electrodes.

9 Claims, 7 Drawing Sheets

(56) References Cited

U.S. PATENT DOCUMENTS

2019/0293220 A1* 9/2019 Tsai ..... G01K 1/02

FOREIGN PATENT DOCUMENTS

| | | | | | |
|---|---|---|---|---|---|
| CN | 202778763 | U | * | 3/2013 | |
| CN | 204194160 | U | | 3/2015 | |
| CN | 204380885 | U | | 6/2015 | |
| CN | 104772236 | A | * | 7/2015 | |
| CN | 105750103 | B | | 7/2016 | |
| CN | 205701136 | U | | 11/2016 | |
| EP | 1958700 | A2 | * | 8/2008 | ..... B05B 3/04 |
| EP | 2158972 | A1 | | 3/2010 | |
| KR | 200371467 | Y1 | * | 12/2004 | |
| TW | 590422 | U | * | 2/2020 | |

* cited by examiner

SELF-POWER-GENERATING WATER OUTFLOW DEVICE WITH A LIGHT

RELATED APPLICATIONS

This application is a continuation of and claims priority to Chinese patent application number 201921332006.3, filed on Aug. 16, 2019, which is incorporated herein by reference.

FIELD OF THE DISCLOSURE

The present disclosure relates to a self-power-generating water outflow device with a light.

BACKGROUND OF THE DISCLOSURE

Existing self-power-generating water outflow devices with a light, such as disclosed in the Chinese patent application number CN105750103B and titled "A self-power-generating showerhead with a light and the working method thereof", can supply power for a light emitting diode (LED) lamp through a micro power generator. However, as can be seen from the specification and the drawings, the micro power generator and the LED lamp are fixedly mounted in a housing. The LED lamp has a long service life and is expensive, while the micro power generator has a short service life and is inexpensive. When the micro power generator is damaged, the entire showerhead must be replaced even if the LED lamp is not damaged, resulting in great waste of resources.

BRIEF SUMMARY OF THE DISCLOSURE

The present disclosure provides a self-power-generating water outflow device with a light, which overcomes the deficiencies of the background art. The technical solution adopted by the present disclosure to solve the technical problems thereof is as follows.

A self-power-generating water outflow device with a light comprises a water outflow terminal and a connector detachably connected to the water outflow terminal. The water outflow terminal comprises a light emitting diode (LED) light source, a driving circuit for driving the LED light source, a first positive electrode electrically connected to the driving circuit, and a first negative electrode electrically connected to the driving circuit. The connector comprises a connection housing and a self-power-generating component. The self-power-generating component is disposed in the connection housing, and the connection housing comprises one or more second positive electrodes and one or more second negative electrodes electrically connected to the self-power-generating component. When the connector is connected to the water outflow terminal, the first positive electrode is in contact with the one or more second positive electrodes and the first negative electrode is in contact with the one or more second negative electrodes.

In another preferred embodiment, a top of the water outflow terminal comprises an assembly cavity, and a bottom of the connection housing is coupled to the assembly cavity.

In another preferred embodiment, a bottom wall of the assembly cavity comprises a first accommodating groove and a second accommodating groove. The first positive electrode and the first negative electrode are both sheets, and the first positive electrode and the first negative electrode are respectively fixedly disposed in the first accommodating groove and the second accommodating groove. The one or more second positive electrodes and the one or more second negative electrodes are both column-shaped bodies.

In another preferred embodiment, the first accommodating groove is annular, and the second accommodating groove is circular and located in the first accommodating groove. The first positive electrode is an annular sheet, and the first negative electrode is a circular sheet.

In another preferred embodiment, the one or more second positive electrodes comprise two second positive electrodes. The two second positive electrodes are symmetrically arranged. The one or more second negative electrodes comprise a second negative electrode.

In another preferred embodiment, the assembly cavity comprises an internal thread, and the connection housing comprises an external thread. The connector is connected to the water outflow terminal by engagement of the internal thread and the external thread.

In another preferred embodiment, the self-power-generating component comprises a power generator and an impeller. The impeller is rotatably disposed in the connection housing, and the power generator is fixedly disposed in the connection housing.

In another preferred embodiment, the water outflow terminal further comprises a limiting mechanism configured to control rotation of the impeller, and the limiting mechanism is disposed on the connection housing.

In another preferred embodiment, the limiting mechanism is a limiting column laterally and movably disposed on the connection housing, and the limiting column moves laterally between a position abutting the impeller and a position away from the impeller.

Compared with the background art, the technical solution has the following advantages. First, since the connector and the water outflow terminal can be separated, the self-power-generating component can be separated from the LED light source. When the LED light source is not damaged but the self-power-generating component is damaged, the connector can be replaced in time while the original water outflow terminal can be retained. This can greatly reduce replacement cost. Second, the first positive electrode and the first negative electrode are both sheets, and the one or more second positive electrodes and the one or more second negative electrodes are both column-shaped bodies. When the connector and the water outflow terminal are assembled, the column-shaped bodies of the one or more second positive electrodes and the one or more second negative electrodes easily contact the sheets of the first positive electrode and the first negative electrode. Third, the first positive electrode is an annular sheet, and the first negative electrode is a circular sheet. When the connector is rotatably screwed to the water outflow terminal, the annular sheet and the circular sheet can be better adapted to the rotation of the connector. Fourth, there are two second positive electrodes symmetrically arranged, which further ensures the stability of the contact between the two second positive electrodes and the first positive electrode. Fifth, the water outflow device further comprises a limiting mechanism configured to control rotation of the impeller. When the connector needs to perform a water outflow test independently, the rotation of the impeller can be restricted by the limiting mechanism to prevent the power generator from burning out due to the energy the power generator generates when the impeller rotates. Sixth, the limiting mechanism has a movable limit column structure, and the structure of the limiting mechanism is simple and easy to use.

BRIEF DESCRIPTION OF THE DRAWINGS

The present disclosure will be further described below in conjunction with the accompanying drawings and embodiments.

DETAILED DESCRIPTION OF THE EMBODIMENTS

Please refer to FIG. 1 to FIG. 6, a first embodiment of a self-power-generating water outflow device with a light comprises a water outflow terminal 10 and a connector 20.

Figure 5:
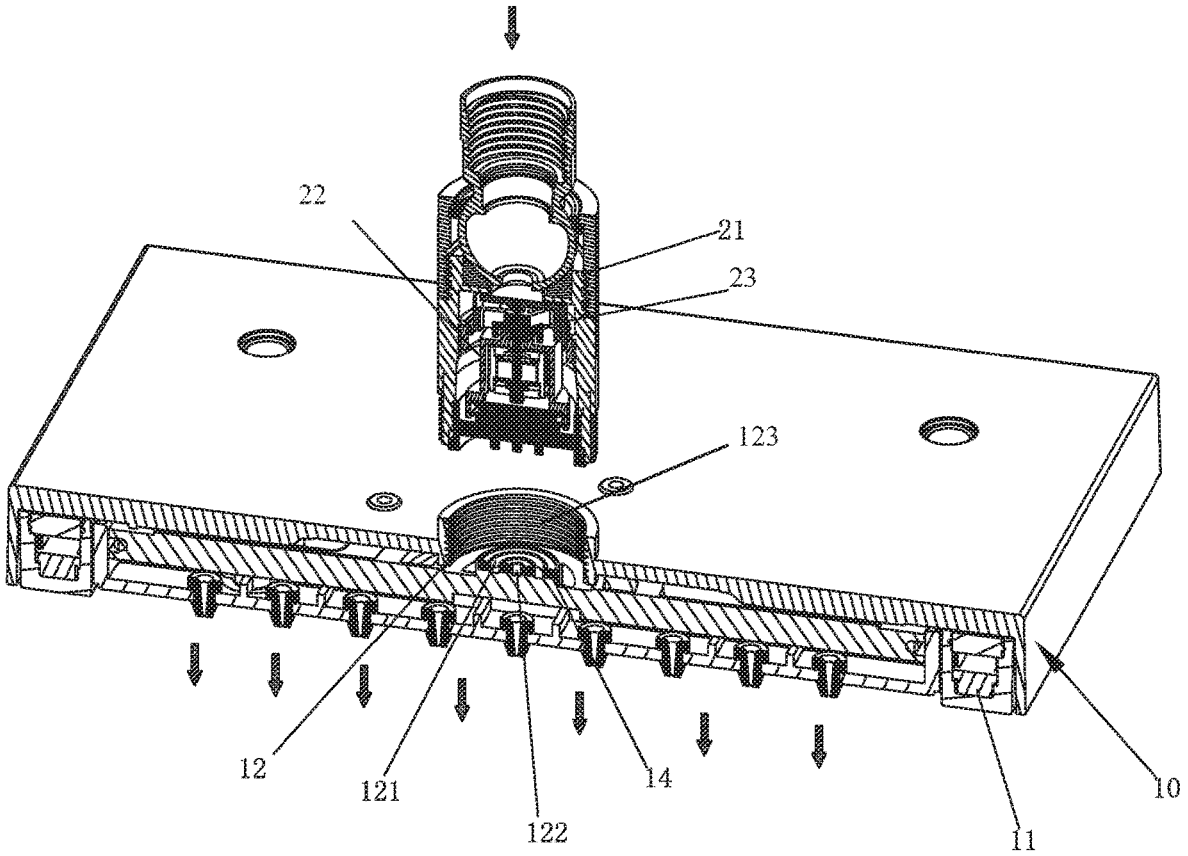
FIG. 5 illustrates a second cross-sectional view of the water outflow device according to the first embodiment, in which the connector and the water outflow terminal are separated from each other.
Figure 6:
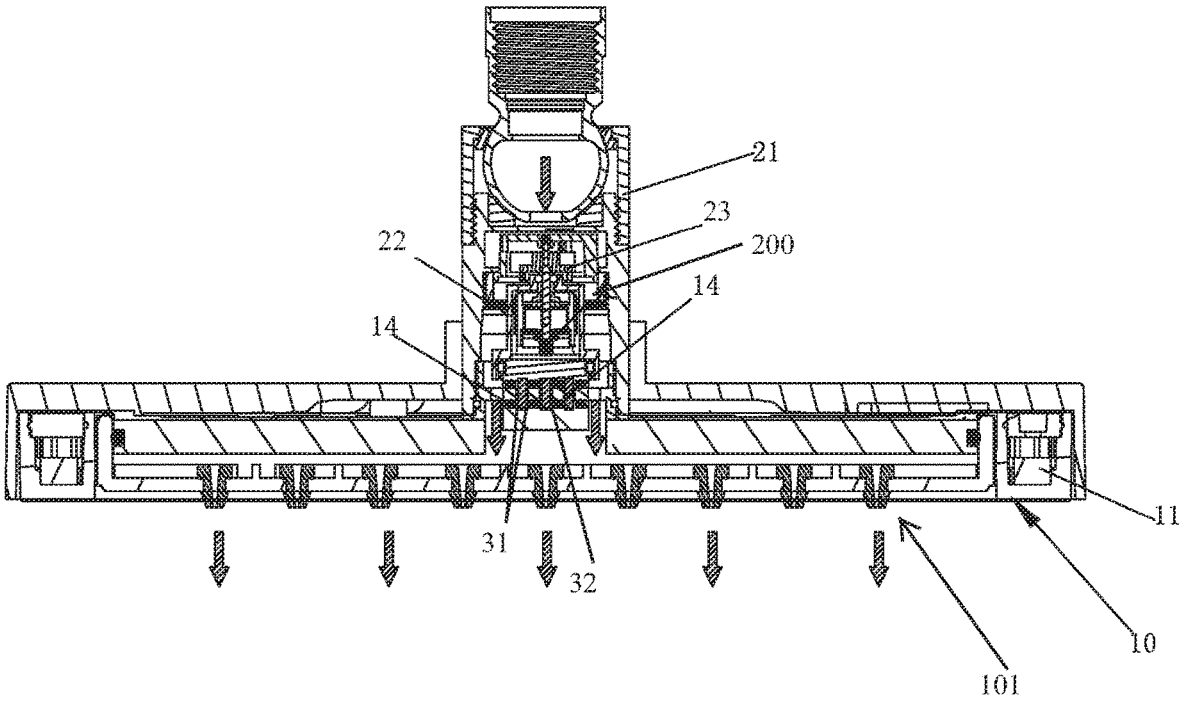
FIG. 6 illustrates a third cross-sectional view of the water outflow device according to the first embodiment, in which the connector and the water outflow terminal are in an assembled state.

An inner side of the water outflow terminal 10 comprises a light emitting diode (LED) light source 11 and a driving circuit for driving the LED light source (not shown). The water outflow terminal 10 further comprises a first positive electrode 31 and a first negative electrode 32 electrically connected to the driving circuit. As shown in FIG. 5, the LED light source 11 is disposed on an outer circumference of a water outflow 101 of the water outflow terminal 10.

In this embodiment, a top of the water outflow terminal 10 comprises an assembly cavity 12.

In this embodiment, a bottom wall of the assembly cavity 12 comprises a first accommodating groove 121 and a second accommodating groove 122. The first positive electrode 31 and the first negative electrode 32 are both sheets and are respectively fixedly disposed in the first accommodating groove 121 and the second accommodating groove 122.

In this embodiment, the first accommodating groove 121 is annular, and the second accommodating groove 122 is circular and located in the first accommodating groove 121. The first positive electrode 31 is an annular sheet. The first negative electrode 32 is a circular sheet. As shown in FIG. 5, the first accommodating groove 121 and the second accommodating groove 122 are arranged concentrically. Sealing grooves 13 are disposed between the first accommodating groove 121 and the second accommodating groove 122 and at an outer side of the first accommodating groove 121. Two sealing rings 14 are respectively disposed in the two sealing grooves 13.

As shown in FIG. 5, the assembly cavity 12 comprises an internal thread 123.

The connector 20 is detachably connected to the water outflow terminal 10 and comprises a connection housing 21 and a self-power-generating component 200. The self-power-generating component 200 is disposed in the connection housing 21, and the connection housing 21 comprises one or more second positive electrodes 211 and one or more second negative electrodes 212 electrically connected to the self-power-generating component 200. When the connector 20 is connected to the water outflow terminal 10, the first positive electrode 31 is in contact with the one or more second positive electrodes 211, and the first negative electrode 32 is in contact with the one or more second negative electrodes 212.

In this embodiment, a bottom of the connection housing 21 is coupled to the assembly cavity 12.

In this embodiment, the one or more second positive electrodes 211 and the one or more second negative electrodes 212 are both column-shaped bodies.

Figure 1:
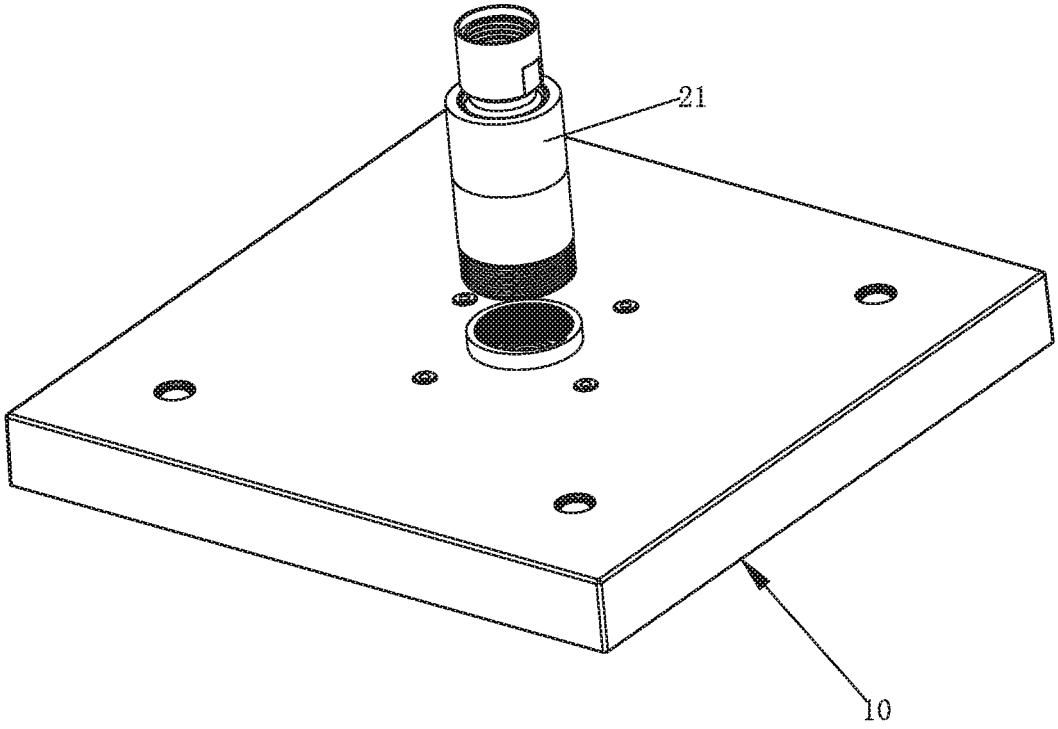
FIG. 1 illustrates a perspective view of a water outflow device according to a first embodiment, in which a connector and a water outflow terminal are separated from each other.
Figure 2:
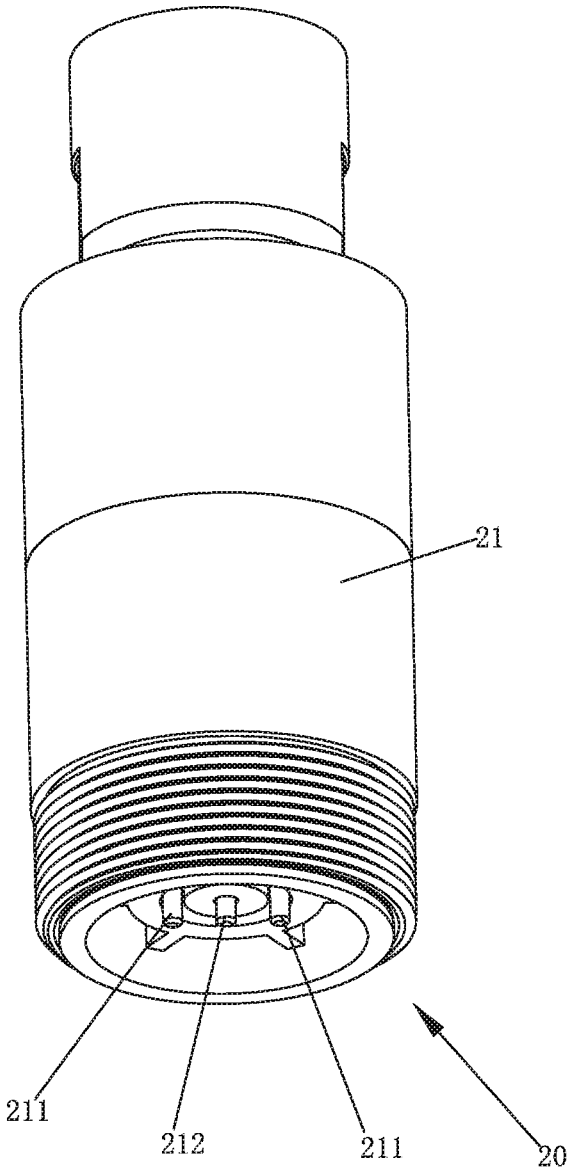
FIG. 2 illustrates a perspective view of the connector.
Figure 3:
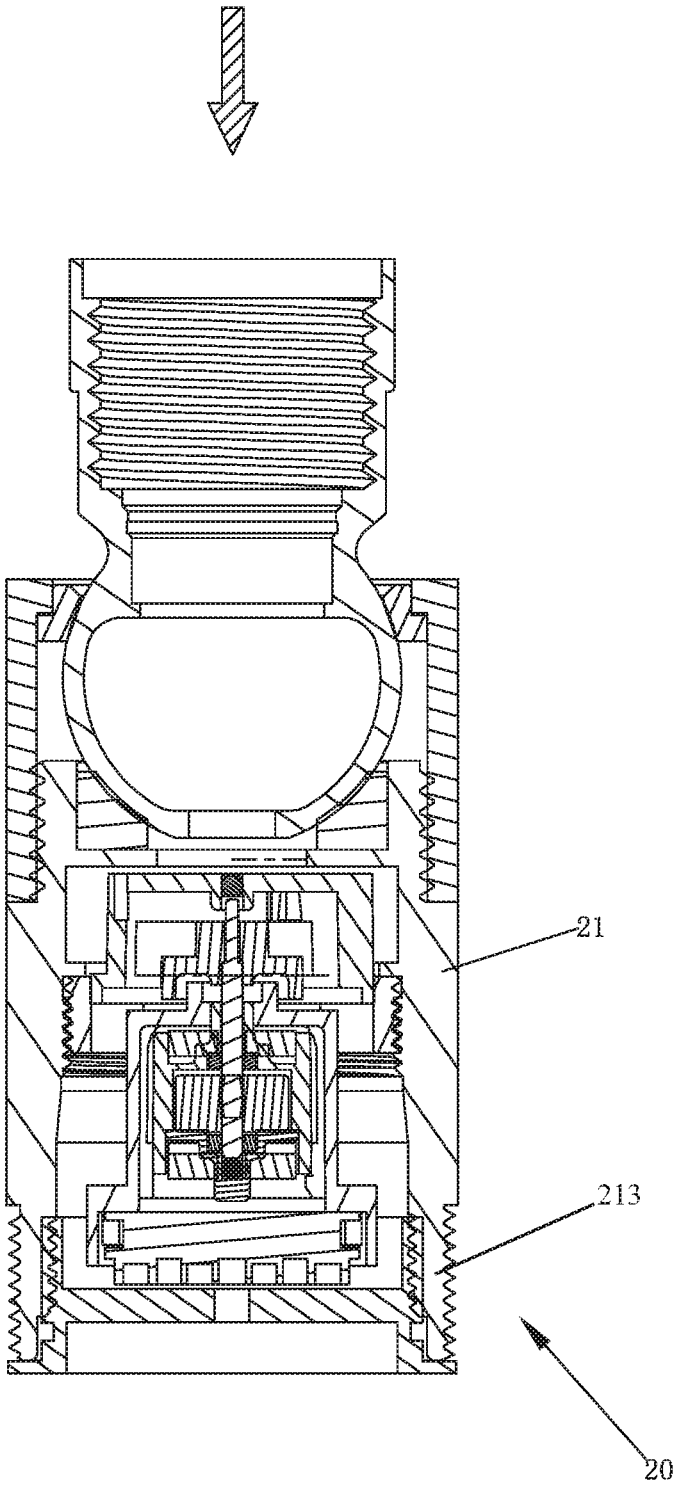
FIG. 3 illustrates a cross-sectional view of the connector.
Figure 4:
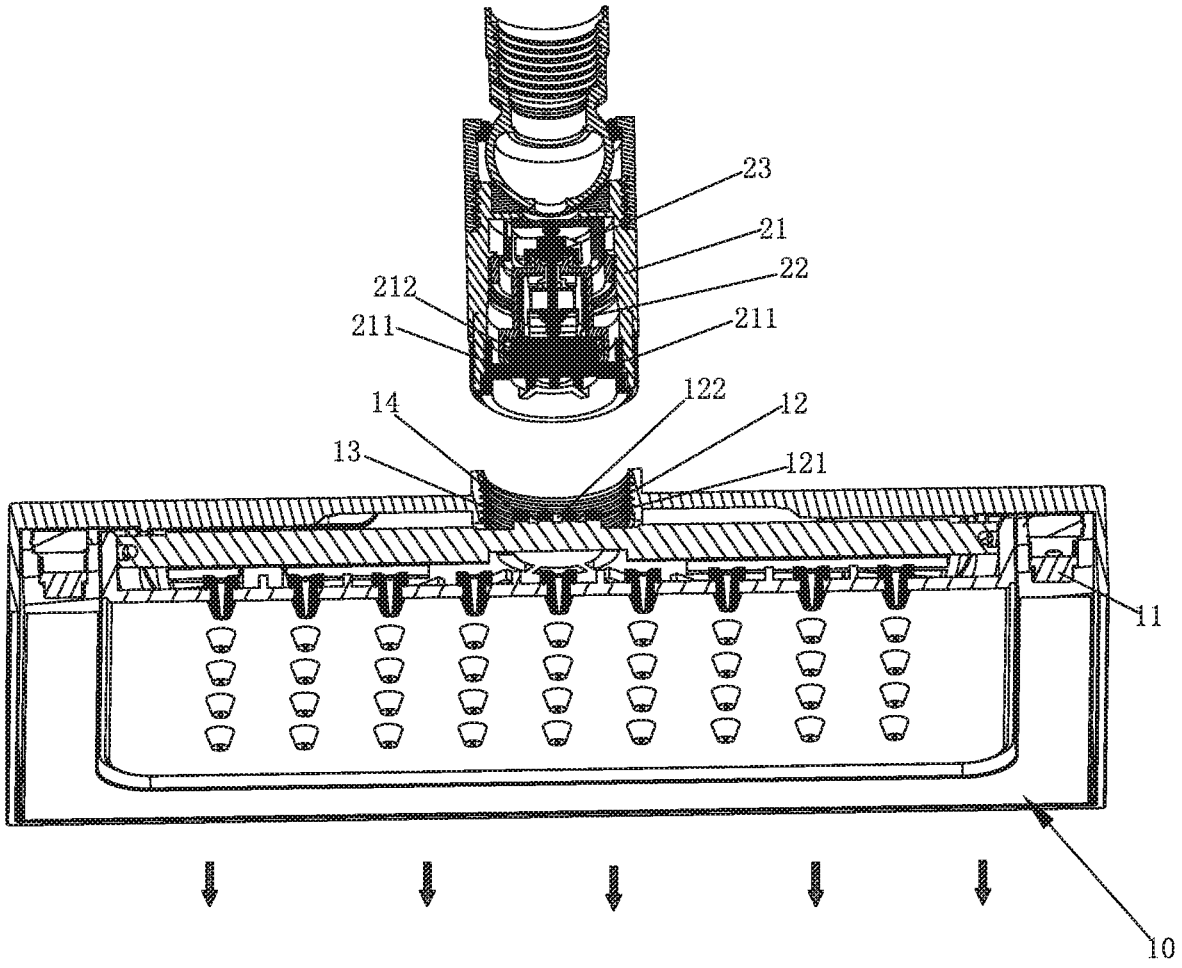
FIG. 4 illustrates a first cross-sectional view of the water outflow device according to the first embodiment, in which the connector and the water outflow terminal are separated from each other.

In this embodiment, the one or more second positive electrodes 211 comprise two second positive electrodes 211 symmetrically arranged, and the one or more second negative electrodes 212 comprise a second negative electrode 212. As shown in FIG. 2, the second negative electrode 212 is located between the two second positive electrodes 211.

In this embodiment, the connection housing 21 comprises an external thread 213, and the connector 20 is connected to the water outflow terminal 10 by engagement of the internal thread 123 of the assembly cavity 12 and the external thread 213 of the connection housing 21. The connection of the connection housing 21 and the water outflow terminal 10 can also be carried out in other manners, such as by snap fastening.

In this embodiment, the self-power-generating component 200 comprises a power generator 22 and an impeller 23. The impeller 23 is rotatably disposed in the connection housing 21, and the power generator 22 is fixedly disposed in the connection housing 21. The structure of the power generator 22 and the impeller 23 is conventional and will not be further described herein.

Figure 7:
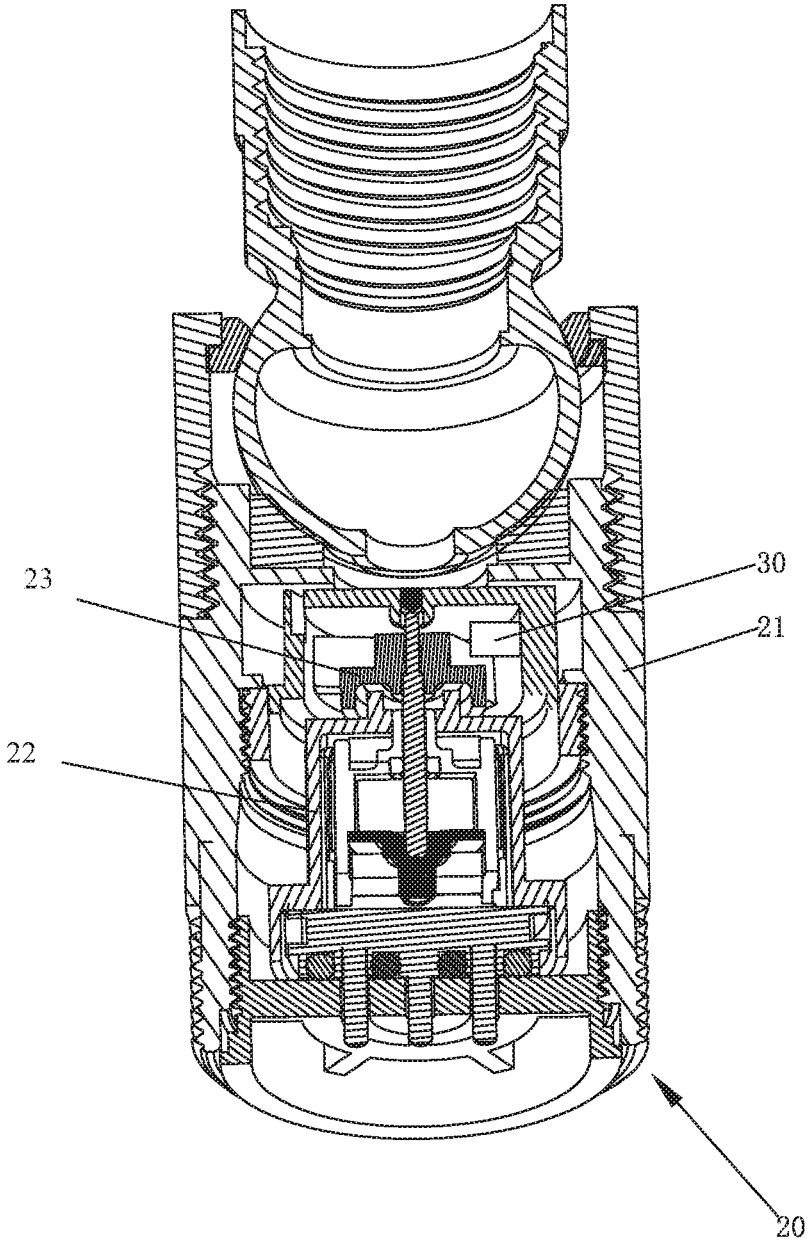
FIG. 7 illustrates a cross-sectional view of the connector according to a second embodiment.

In a second embodiment, as shown in FIG. 7, the water outflow terminal 10 further comprises a limiting mechanism 30 configured to control rotation of the impeller 23. The limiting mechanism 30 is disposed on the connection housing 21.

In the second embodiment, the limiting mechanism 30 is a limiting column laterally and movably disposed on the connection housing 21, and the limiting column moves laterally between a position abutting the impeller 23 and a position away from the impeller 23. Specifically, a threaded hole may be disposed on a side wall of the connection housing 21, and an external thread is disposed on an outer circumference of the limiting column. A threaded engagement of the threaded hole and the external thread enables the limiting column to be laterally and movably disposed on the connection housing 21. When rotation of the impeller 23 needs to be limited, it is only necessary to rotate the limiting column to cause an end of the limiting column to be located between blades of the impeller 23. When the impeller 23 is to be reset to rotate, it is only necessary to rotate the limiting column to cause the end of the limiting column to move away from the impeller 23.

The limiting mechanism 30 can also adopt other structures as needed, such as a button structure of a ballpoint pen, which can drive the limiting column to move. The structure of the limiting mechanism 30 is not limited to what is disclosed, and can include other structures that can control the rotation of the impeller 23.

The water outflow terminal 10 may be a shower, a top spray, a faucet, a pull-out faucet, a spray gun, etc., but is not limited thereto.

Although the present disclosure has been described with reference to embodiments thereof for carrying out the disclosure, it is apparent to those skilled in the art that a variety of modifications and changes may be made without departing from the scope of the disclosure.

What is claimed is:

1. A self-power-generating water outflow device with a light, comprising:

a water outflow terminal, comprising:

a light emitting diode (LED) light source, a driving circuit for driving the LED light source, a first positive electrode electrically connected to the driving circuit, and a first negative electrode electrically connected to the driving circuit, and a connector detachably connected to the water outflow terminal, wherein:

the connector comprises a connection housing and a self-power-generating component, the self-power-generating component is disposed in the connection housing, the connection housing comprises one or more second positive electrodes and one or more second negative electrodes electrically connected to the self-power-generating component, and when the connector is connected to the water outflow terminal, the first positive electrode is in contact with the one or more second positive electrodes and the first negative electrode is in contact with the one or more second negative electrodes.

2. The self-power-generating water outflow device with the light according to claim 1, wherein:

a top of the water outflow terminal comprises an assembly cavity, and a bottom of the connection housing is coupled to the assembly cavity.

3. The self-power-generating water outflow device with the light according to claim 2, wherein:

a bottom wall of the assembly cavity comprises a first accommodating groove and a second accommodating groove, the first positive electrode and the first negative electrode are both sheets, the first positive electrode and the first negative electrode are respectively fixedly disposed in the first accommodating groove and the second accommodating groove, and the one or more second positive electrodes and the one or more second negative electrodes are both column-shaped bodies.

4. The self-power-generating water outflow device with the light according to claim 3, wherein:

the first accommodating groove is annular, the second accommodating groove is circular and located in the first accommodating groove, the first positive electrode is an annular sheet, and the first negative electrode is a circular sheet.

5. The self-power-generating water outflow device with the light according to claim 4, wherein:

the one or more second positive electrodes comprise two second positive electrodes, the two second positive electrodes are symmetrically arranged, and the one or more second negative electrodes comprise a second negative electrode.

6. The self-power-generating water outflow device with the light according to claim 4, wherein:

the assembly cavity comprises an internal thread, the connection housing comprises an external thread, and the connector is connected to the water outflow terminal by engagement of the internal thread and the external thread.

7. The self-power-generating water outflow device with the light according to claim 1, wherein:

the self-power-generating component comprises a power generator and an impeller, the impeller is rotatably disposed in the connection housing, and the power generator is fixedly disposed in the connection housing.

8. The self-power-generating water outflow device with the light according to claim 7, wherein:

the water outflow terminal further comprises a limiting mechanism configured to control rotation of the impeller, and the limiting mechanism is disposed on the connection housing.

9. The self-power-generating water outflow device with the light according to claim 8, wherein:

the limiting mechanism is a limiting column laterally and movably disposed on the connection housing, and the limiting column moves laterally between a position abutting the impeller and a position away from the impeller.

* * * * *